US006830041B2

(12) United States Patent
Kusaka

(10) Patent No.: US 6,830,041 B2
(45) Date of Patent: Dec. 14, 2004

(54) BREATHER DEVICE OF VEHICLE ENGINE

(75) Inventor: Takuya Kusaka, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/625,656

(22) Filed: Jul. 24, 2003

(65) Prior Publication Data

US 2004/0016423 A1 Jan. 29, 2004

(30) Foreign Application Priority Data

Jul. 29, 2002 (JP) ..... 2002-219955

(51) Int. Cl.[7] ..... F01L 13/00
(52) U.S. Cl. ..... 123/572; 123/573
(58) Field of Search ..... 123/572–574, 123/41.86

(56) References Cited

U.S. PATENT DOCUMENTS 6,457,462 B2 * 10/2002 Moren ..... 123/572
6,460,525 B1 * 10/2002 Shureb ..... 123/572
6,644,290 B2 * 11/2003 Yoneyama et al. ..... 123/572
6,651,635 B2 * 11/2003 Kunimitsu et al. ..... 123/572

* cited by examiner

*Primary Examiner*—Marguerite McMahon
(74) *Attorney, Agent, or Firm*—Oblon, Spivak, McClelland, Maier & Neustadt, P.C.

(57) ABSTRACT

A breather device of a vehicle engine is arranged so as to shut off an engine intake system from heat of an engine exhaust system and to make effective use of dead space for location. The breather device includes a breather tank arranged independently between the engine intake system and the engine exhaust system on the rear side of a cylinder assembly of the engine above a crankcase thereof; and a plurality of breather pipes connecting the breather tank to the engine and the engine intake system.

8 Claims, 8 Drawing Sheets

BREATHER DEVICE OF VEHICLE ENGINE

BACKGROUND OF THE INVENTION

The present invention relates to a breather device of an engine of a vehicle.

Generally, in an engine of a vehicle, gas accompanied by pressure generated in a cylinder bore of the engine leaks into a crankcase by little or trace amount through a clearance between a piston and the cylinder bore. As the pressure of the gas in the crankcase incessantly changes according to the sliding motion (displacement) of the piston, if the crankcase is airtight, the pressure of the gas in the crankcase, i.e., so-called blow-by gas, interferes with the movement of the piston. It is, therefore, necessary to provide means, such as breather device, for releasing the blow-by gas in the crankcase and separating an oil content atomized and mixed into the blow-by gas from the gas.

In order to separate the atomized oil content mixed from the blow-by gas, it is necessary to form a breather chamber having a predetermined inner volume. It is, however, difficult for the layout to form the breather chamber having the sufficient volume for an engine of a diminutive vehicle having compact size according to one of development objectives. Therefore, in order to secure the sufficient volume of the breather chamber, in the prior art, there is proposed an arrangement in which a breather tank is located outside the engine.

A general arrangement in the prior art such as mentioned above is shown in FIGS. 10 and 11.

With reference to FIGS. 10 and 11, a breather tank 8 is arranged in a space surrounded by a crankcase 2 and a cylinder head 3 of an engine 1, an air cleaner 4 which constitutes an intake system, an outlet tube 6 extending from the air cleaner 4 towards a carburetor 5 disposed at a rear portion of the cylinder head 3, and an exhaust pipe 7 which constitutes an exhaust system provided on one side of the engine 1.

In a recent structure, the blow-by gas is caused to circulate in the air cleaner 4 for carrying out re-combustion to thereby prevent air pollution.

However, the outlet tube is normally made of an elastic material so as to improve the assembling property of the tube and is, therefore, sometimes inferior in heat resistance. In addition, the outer surface temperature of the exhaust pipe becomes elevated since high temperature exhaust gas passes through the interior of the exhaust pipe.

As a result, it is required for the outlet tube and the exhaust pipe to be separated in arrangement from each other. Thus, the width of the vehicle increases, and the space between the outlet tube and the exhaust pipe constitutes a dead space, being inconvenient and not advantageous.

SUMMARY OF THE INVENTION

The present invention was conceived in consideration of the circumstances in the prior art mentioned above, and it is therefore an object of the present invention to provide a breather device of a vehicle engine capable of shutting off an intake system from heat of an exhaust system and making effective use of a dead space between an outlet tube of the intake system and an exhaust pipe of the exhaust system.

This and other objects of the present invention can be achieved by providing a breather device of an engine of a vehicle in which an engine including a crankcase and a cylinder assembly, which comprises a cylinder block arranged on an upper surface of the crankcase, a cylinder head and a cylinder cover, is mounted to a vehicle body frame, an engine intake system is arranged on a rear side of the cylinder assembly, an engine exhaust system is arranged on one side of the engine, and a breather device is arranged in the vehicle body so as to release a blow-by gas in the crank case and to separate an oil content in the blow-by gas therefrom, the breather device comprising:

a breather tank arranged independently between the engine intake system and the engine exhaust system on the rear side of the cylinder assembly and above the crankcase; and a plurality of breather pipes connecting the breather tank to the engine and the engine intake system.

In a preferred embodiment of this aspect, the breather tank may be arranged between an outlet tube of the engine intake system and an exhaust pipe of the engine exhaust system.

The breather tank has a side surface which faces the engine intake system and is curved along an outer configuration of the engine intake system. The breather tank is provided with a plurality of breather chambers formed therein by dividing an interior thereof by means of partition walls so as to communicate with each other, and unions for connection to the breather pipes are arranged respectively to the breather chambers. The breather tank is arranged just above the crankcase, a further breather chamber is arranged in an upper portion of the crankcase directly under the breather tank, and the further breather chamber is communicated with the one of the plural breather chambers in the breather tank through one of the breather pipes.

The breather pipes are arranged so as to be curved and arranged at positions higher in height level than an entire structure of the engine including the engine intake system and the engine exhaust system.

The engine intake system includes air cleaner provided, at an upper portion thereof, with an intake duct extending obliquely forward towards upward, the intake duct having an intake port at an upper end of the intake duct, and the breather tank is disposed in parallel to the intake port as viewed in a plan view and arranged between the intake port and the engine exhaust system and above the engine exhaust system.

According to the breather device of a vehicle engine of the characters mentioned above, the breather tank functions as a heat shielding member to make it difficult to transfer the heat emitted from the engine exhaust system to the engine intake system. Therefore, it is possible to arrange the engine exhaust system and the engine intake system more proximately to each other, reduce the width of the vehicle and make effective use of the dead space in the vehicle body.

It is therefore possible to sufficiently secure the volume of the breather tank even in narrow space for location and improve gas-liquid separation performance, and in addition, an easy arrangement of the breather pipe can be also made possible.

Furthermore, the separated oil content can smoothly return to the engine and the engine starting operation can be done with substantially no failure, improving the output power performance of the engine.

The nature and further characteristic features of the present invention will be made more clear from the following descriptions made with reference to the accompanying drawings.

DESCRIPTION OF THE PREFERRED EMBODIMENT

An embodiment of the present invention will be described hereinafter with reference to the accompanying drawings.

Further, it is to be noted that terms of "upper", "lower", "right", "left" and the like are used herein with reference to the accompanying drawings or in a vehicle standing state.

Figure 1:
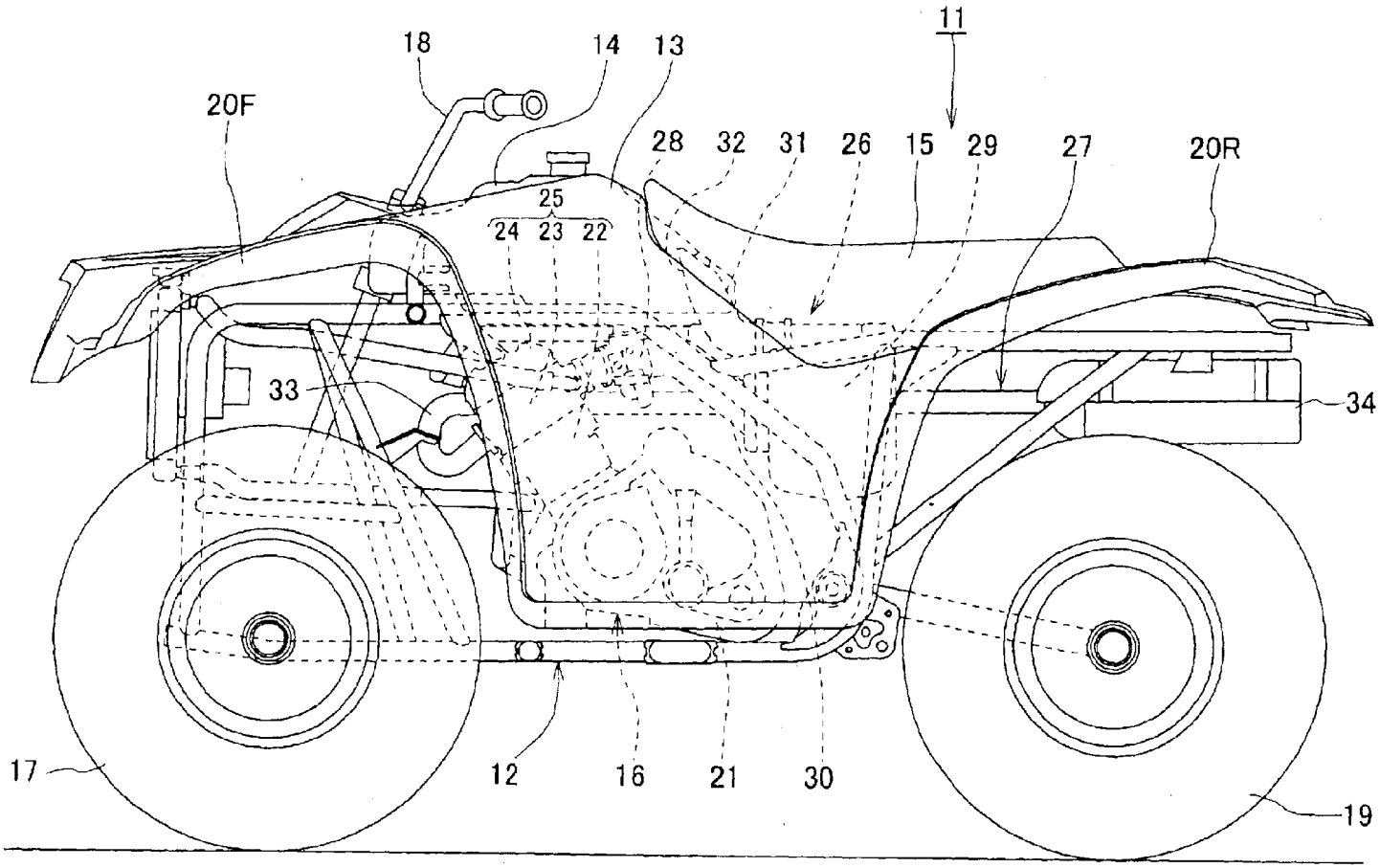
FIG. 1 is a left side view of a saddle-riding type off-road vehicle provided with a breather device of a vehicle engine according to one embodiment of the present invention.

With reference to FIG. 1 showing a saddle-riding type off-road vehicle 11, including a vehicle body frame 12, an upper portion of the vehicle body frame 12 is covered by a vehicle body cover 13 which is formed to be integral with or independent from the vehicle body frame 12.

A fuel tank 14 is provided inside of the vehicle body cover 13 at a portion near the front upper side thereof and a saddle-riding type driving seat 15 is arranged rear the fuel tank 14. Further, an engine 16 is mounted in the central lower portion of the vehicle body frame 12 and below the fuel tank 14.

A pair of left and right front wheels 17, as driving wheels, provided with wide and low-pressure tires are arranged in the vehicle body frame 12 in front of the engine 16. The front wheels 17 are supported to the vehicle body frame 12 by means of front wheel suspension device, not shown, to be vertically swingable (rockable). Further, a steering handle 18 that constitutes a front wheel steering device is provided in front of the fuel tank 14, and the front wheels 17 are laterally steered by the steering wheel 18.

A pair of left and right rear wheels 19, as driven wheels, provided with wide and low-pressure tires are arranged on the left and right side of the vehicle body frame 12, respectively, at the rear portion of the engine 16. The rear wheels 19 are also supported to the vehicle body frame 12 by means of rear wheel suspension device, not shown, to be vertically swingable.

Fenders 20 covering the front and rear wheels 17 and 19 are arranged on both the sides of the vehicle body cover 13. The fenders 20 include a pair of left and right front fenders 20F to be integral with or formed integrally with the vehicle body cover 13 so as to cover the front wheels 17 and also include a pair of left and right rear fenders 20R to be integral with or formed integrally with the vehicle body cover 13 so as to cover the rear wheels 19.

The engine 16 mounted in the vehicle body frame 12 is, for example, a four-stroke-cycle single-cylinder engine. The engine 16 includes a crankcase 21 and a cylinder assembly 25 comprising a cylinder block 22, a cylinder head 23, a head cover 24 and the like, which are arranged in front of the upper surface of the crankcase 21 in a slightly forward-bent attitude as well shown in FIG. 2.

An engine intake system 26 is arranged on the rear side of the cylinder assembly 25 below a rider's seat 15 and above the crankcase 21. An engine exhaust system 27 is also arranged on one side of the engine 16, i.e., in this embodiment, on the right side of the engine 16.

Figure 2:
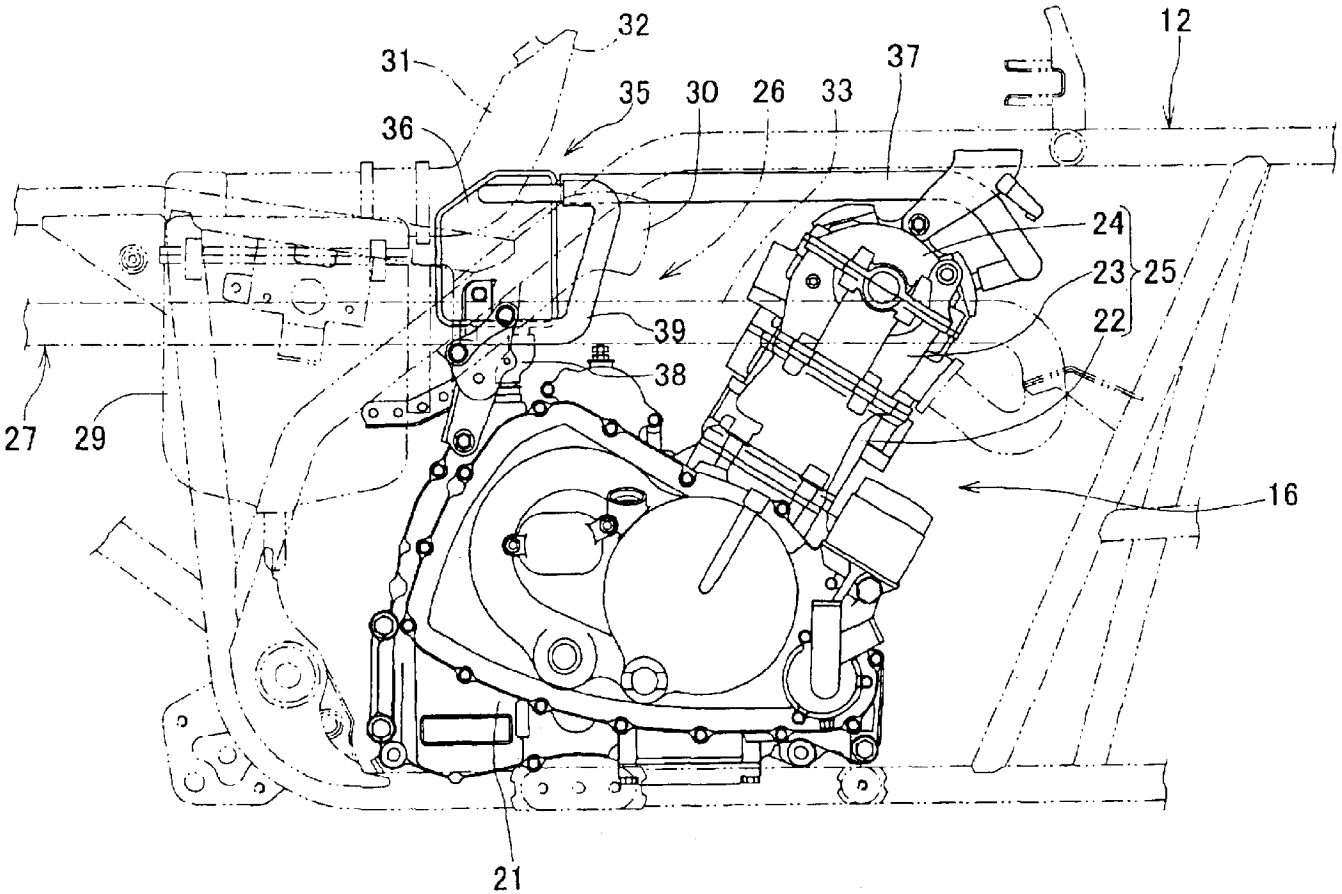
FIG. 2 is an enlarged right side view of the engine of the vehicle of FIG. 1 and the periphery of the engine.
Figure 3:
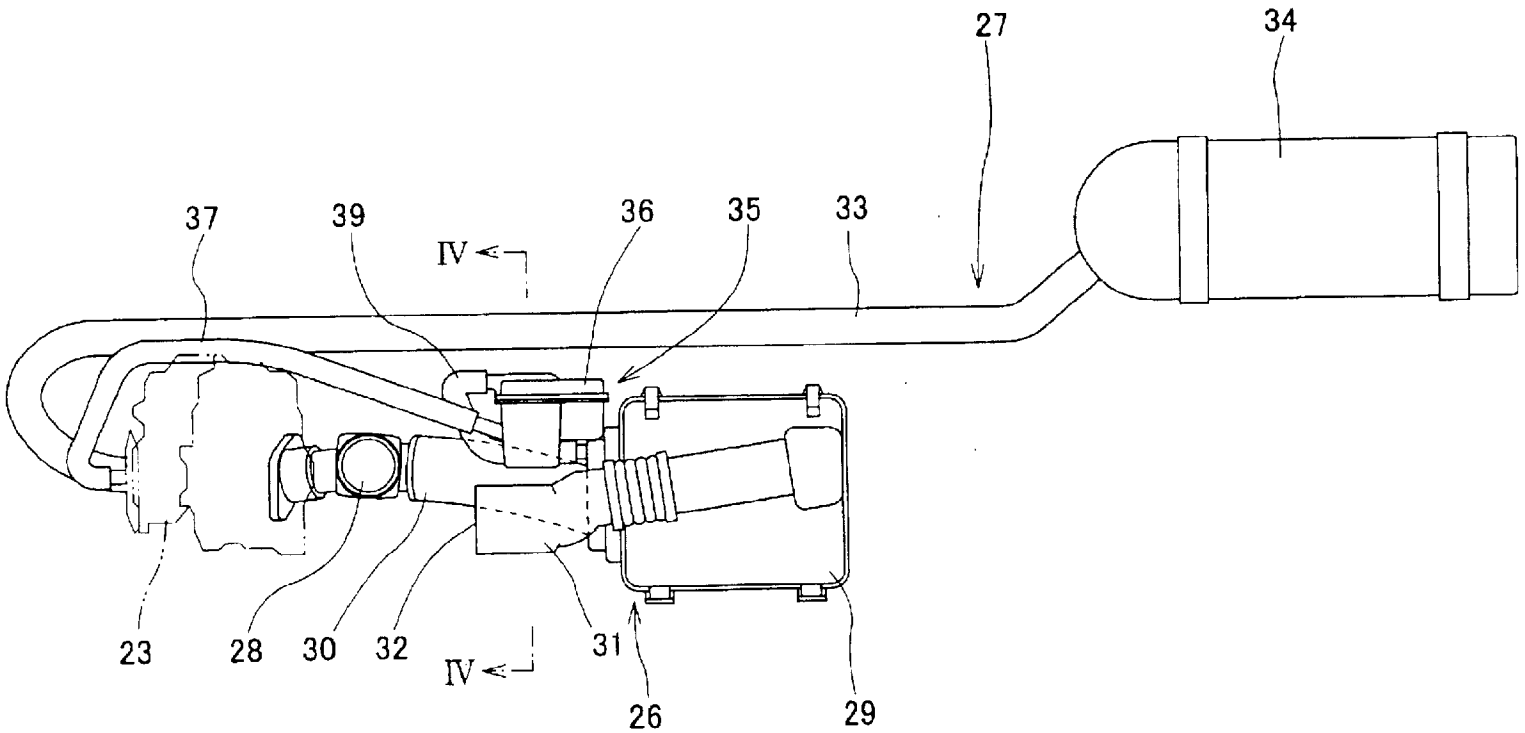
FIG. 3 is a plan view of the arrangement of an engine intake system and an engine exhaust system.
Figure 4:
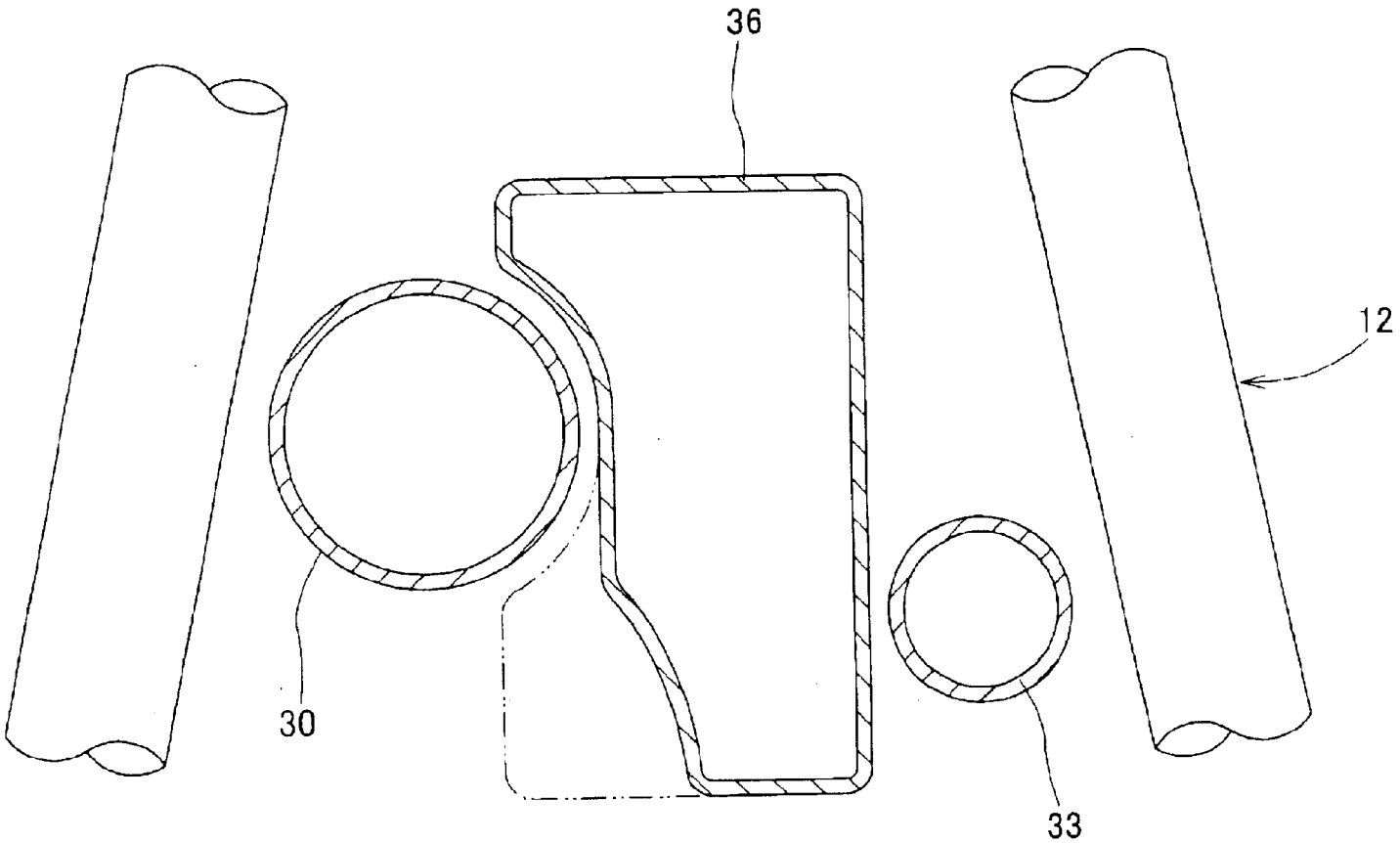
FIG. 4 is a cross-sectional view taken along a line IV—IV of FIG. 3.
Figure 5:
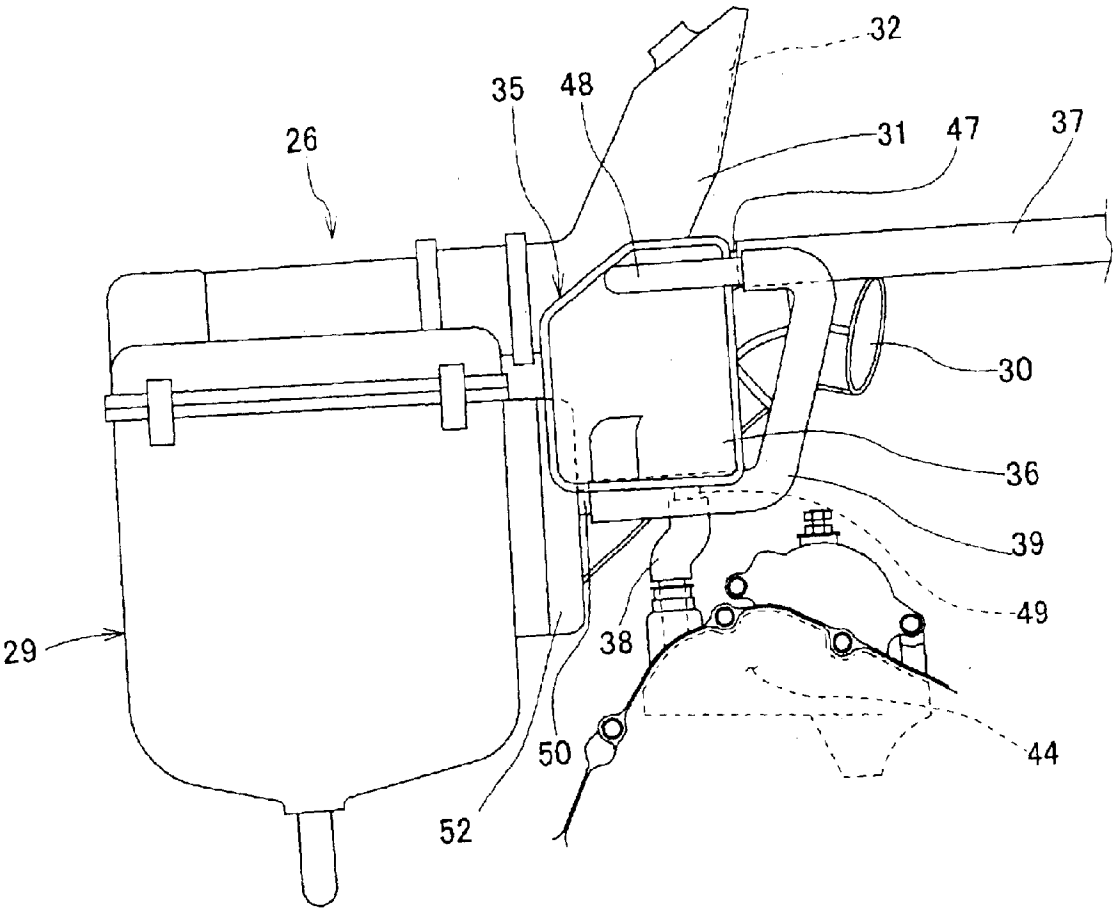
FIG. 5 is an enlarged right side view of the breather device.
Figure 6:
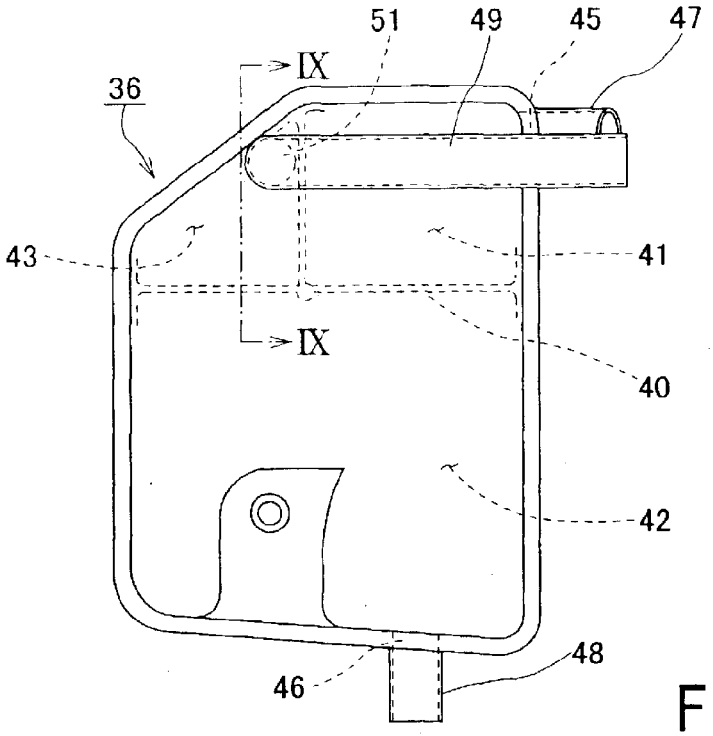
FIG. 6 is a right side view of a breather tank.
Figure 7:
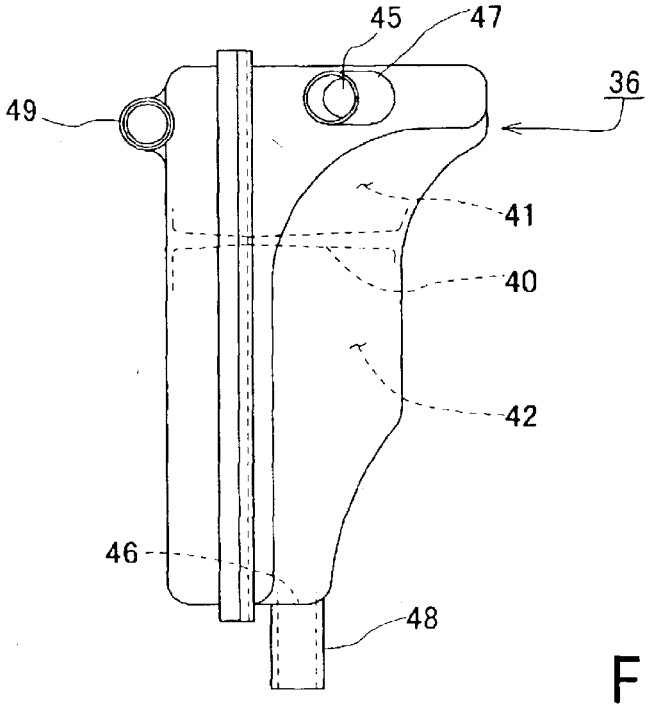
FIG. 7 is a front view of the breather tank.
Figure 8:
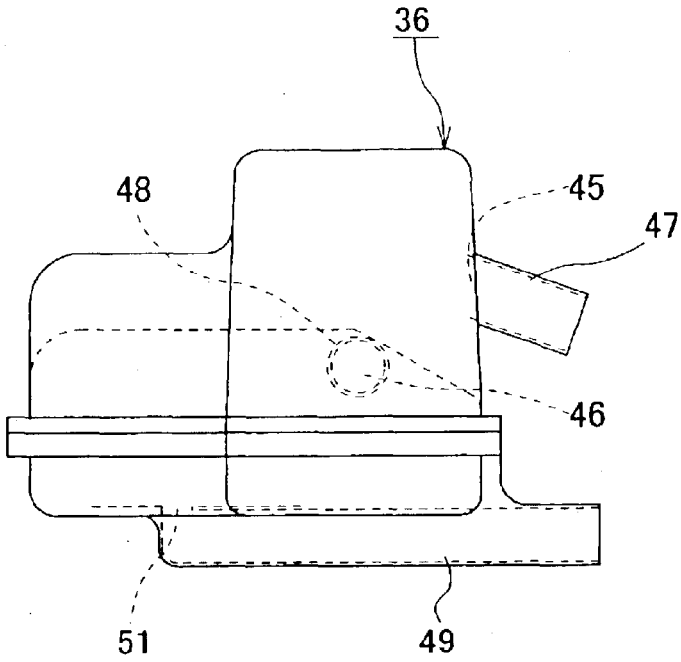
FIG. 8 is a plan view of the breather tank.

FIG. 2 shows the right side view of the engine 16 and the periphery of the engine 16, and FIG. 3 shows the arrangement of the engine intake system 26 and the engine exhaust system 27.

With reference to FIGS. 1 to 3, the engine intake system 26 includes a carburetor 28 connected to the rear portion of the cylinder head 23 and an air cleaner 29 arranged behind the carburetor 28 below the rider's seat 15. The rear surface of the carburetor 28 and the front surface of the air cleaner 29 are connected through an outlet tube 30 made of an elastic material having flexibility. An intake duct or pipe 31 is provided above the air cleaner 29 so as to extend obliquely forward towards the upper portion of the outlet tube 30. The intake duct 31 is formed, at its upper end, with an intake port 32.

On the other hand, the engine exhaust system 27 includes an exhaust pipe 33 and a muffler 34. The upstream end of the exhaust pipe 33 is connected to the front portion of the cylinder head 23, then extends obliquely forward towards the lower portion and is bent rearward so as to extend almost horizontally towards rearward on the right side surface of the engine 16. The muffler 34 is connected to the downstream end of the exhaust pipe 33, which is arranged below the intake system 26.

Meanwhile, the engine 16 of the vehicle 11 is provided with a breather device 35, which is a device or means for releasing a blow-by gas accompanied by pressure generated in the engine 16 and accumulated in the crankcase 21 to the outside of the engine 16 and for separating an oil content atomized and mixed in the blow-by gas from the gas. The breather device 35 mainly includes a breather tank 36 and a plurality of breather pipes or ducts 37, 38, and 39 connected to the breather tank 36.

As shown in FIGS. 2 to 9, the breather tank 36 has a hollow box shape structure having a long side in a vertical direction. The breather tank 36 is arranged between the outlet tube 30 which constitutes the engine intake system 26 and the exhaust pipe 33 which constitutes the engine exhaust system 27 at the rear portion of the cylinder assembly 25 and above the crankcase 21. In the plan view, the breather tank 36 is provided in parallel to the intake port 32 of the intake duct 31.

The breather tank 36 has a side surface facing the outlet tube 30 and being curved along the configuration of the outer surface of the outlet tube 30, and a portion of the breather tank 36, i.e., the upper portion of the breather tank 36 in the described embodiment is curved towards the upper portion of the outlet tube 30 so that, in the plan view, the breather tank 36 is overlapped with the outlet tube 30. As indicated by the two-dot chain line in FIG. 4, in an alternation, the lower portion of the breather tank 36 may be curved towards the lower portion of the outlet tube 30.

The interior of the breather tank 36 is divided, by partition walls, into a plurality of breather chambers 41 to 44 to be communicable with each other. The first breather chamber 41 is provided in the upper front portion of the breather tank 36. A first gas inlet 45 communicating with this first breather chamber 41 is formed to the front surface of the breather tank 36, and a first union 47 for breather pipe connection is provided to this first gas inlet 45.

The second breather chamber 42 is provided in the lower portion of the breather tank 36. A second gas inlet 46 communicating with the second breather chamber 42 is formed to the bottom of the breather tank 36, and a second union 48 for breather pipe connection is provided at this second gas inlet 46.

The third breather chamber 43 is provided at the upper rear portion of the breather tank 36. A gas outlet 51 communicating with this third breather chamber 43 is formed to the right side surface of the breather tank 36, and a third union 49 for breather pipe connection is provided at this gas outlet 51 so as to extend forward.

The fourth breather chamber, not shown, is provided in the head cover 24 of the engine 16. A portion of the blow-by gas accumulated in the crankcase 21 is introduced into this fourth breather chamber, which is connected to the first breather chamber 41 in the breather tank 36 by means of first breather pipe 37 so as to communicate with the first breather chamber 41.

The fifth breather chamber 44 is provided in the upper portion of the crankcase 21 of the engine 16, preferably directly under the breather tank 36. This fifth breather chamber 44 is connected to and communicated with the second breather chamber 42 in the breather tank 36 by means of second breather pipe 38. The blow-by gas accumulated in the crankcase 21 is introduced into this fifth breather chamber 44.

Figure 9:
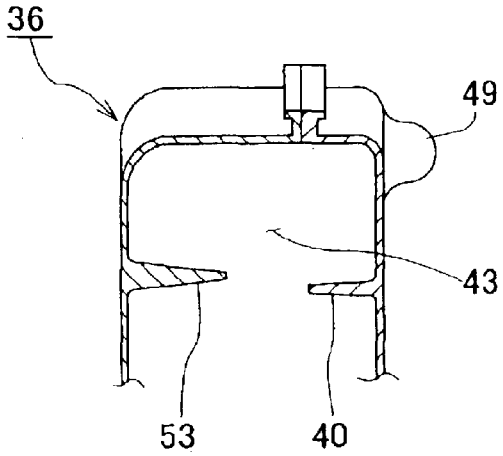
FIG. 9 is a cross-sectional view taken along a line IX—IX of FIG. 6.
Figure 10:
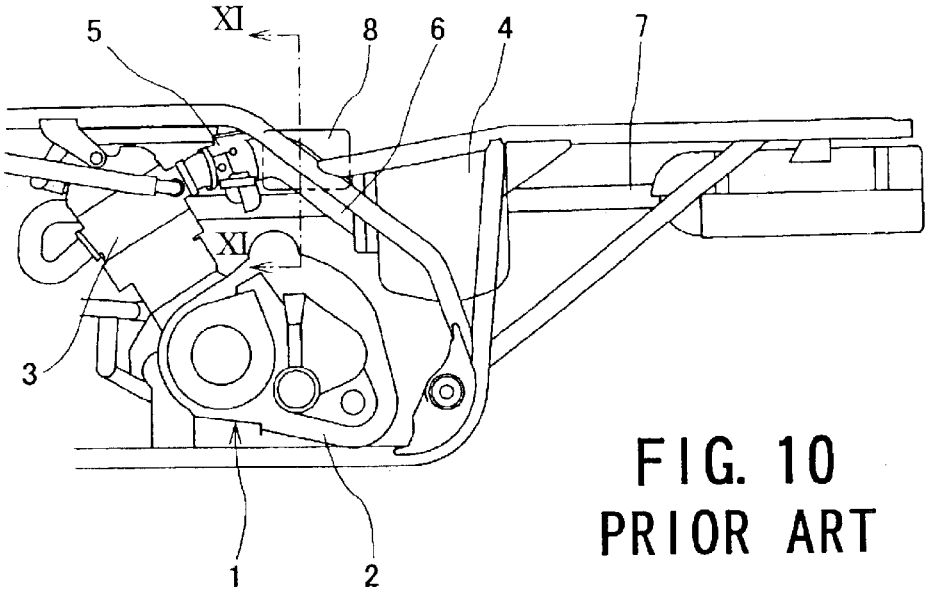
FIG. 10 PRIOR ART
FIG. 10 is an illustration of a left side view of a vehicle, in partial, showing one example of an ordinary arrangement of a conventional breather tank.
Figure 11:
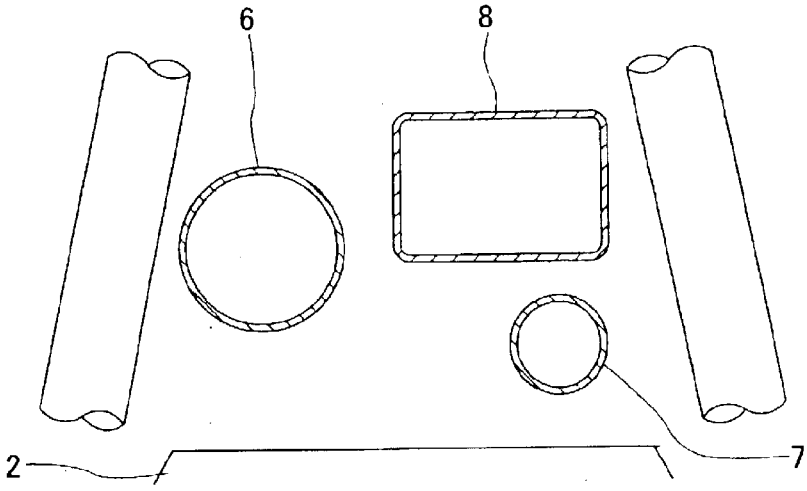
FIG. 11 PRIOR ART
FIG. 11 is a cross-sectional view taken along a line XI—XI of FIG. 10.

As shown in, for example, FIG. 9, a plurality of generally conical pins 53 are built in parallel in each of the breather chambers 41 to 43 in the breather tank 36 to put a flocculent or netted metal material, not shown, for efficiently separating an oil content mixed in the blow-by gas from the gas between the pins 53 and to properly hold the metal at a predetermined position.

Each of the breather pipes 37, 38, and 39 is arranged not to be linear but to be curved so as to make the entire length thereof as long as possible, and furthermore, each of the breather pipes 37, 38, and 39 is arranged at a position higher, in level, than that of the entire structure of the engine 16 including the engine intake system 26 and the engine exhaust system 27.

This embodiment attains functions and effects which will be described hereunder.

The blow-by gas accumulated in the crankcase 21 is partially introduced into the first breather chamber 41 provided in the breather tank 36 from the fourth breather chamber provided in the head cover 24 of the engine 16 by way of the first breather pipe 37, and the remainder of the blow-by gas is, on the other hand, introduced into the second breather chamber 42 provided in the breather tank 36 from the fifth breather chamber 44 provided in the upper portion of the crankcase 21 of the engine 16 by way of the second breather pipe 38. Accordingly, the oil content atomized and mixed into the blow-by gas is separated from the gas and the gas-liquid separation is carried out.

Among the blow-by gas thus subjected to the gas-liquid separation, the oil content is trapped at the bottom of the breather tank 36 and returned through the second gas inlet 46 formed in the bottom of the breather tank 36 to the fifth breather chamber 44 provided in the crankcase 21, and the blow-by gas after the oil content is separated is introduced into a volume chamber 52 provided on the front surface of the air cleaner 29 through the third breather pipe 39, supplied to the engine 16 together with fresh air in the air cleaner 29 and subjected to the re-combustion.

In the described embodiment, the breather tank 36 which constitutes the breather device 35 is provided independently between the outlet tube 30 constituting the engine intake system 26 and the exhaust pipe 33 constituting the engine exhaust system 27 on the rear side of the cylinder assembly 25 and above the crankcase 21. According to this arrangement, the breather tank 36 functions as a heat shielding member to prevent the heat emitted from the exhaust pipe 33 from transferring to the outlet tube 30. As a result, it is possible to arrange the exhaust pipe 33 and the outlet tube 30 more proximately to each other than the arrangement of the conventional breather device, and the width of the vehicle 11 can be hence narrowed.

Moreover, although the space between the outlet tube 30 and the exhaust pipe 33 constitutes a dead space in the conventional structure, according to the present invention, it is possible to make effective use of the dead space as a space for arranging the breather tank 36.

Furthermore, since the side surface of the breather tank 36 which faces the outlet tube 30 is curved along the outer configuration of the outlet tube 30 and the breather tank 36 is constituted to be overlapped with the outlet tube 30 in a plan view, it becomes possible to sufficiently secure the volume of the breather tank 36 even in a narrow space for location and to effectively improve gas-liquid separation performance.

Still furthermore, since the interior of the breather tank 36 is divided by the plural partition walls 40 into a plurality of breather chambers 41 to 44 to be communicable with one another, and the breather pipe connection unions are arranged to be distributed in the respective breather chambers 41 to 44, it becomes possible to further improve the gas-liquid separation performance and easily arrange the breather pipes 37, 38, and 39.

In addition, the breather tank 36 is arranged directly above the crankcase 21, the fifth breather chamber 44 is provided in the inner upper portion of the crankcase 21 just under the breather tank 36, and this fifth breather chamber 44 is connected to the breather tank 36 by the second breather pipe 38. It is possible to smoothly return the separated oil to the engine 16. Moreover, since the blow-by gas is subjected to the gas-liquid separation in advance by the fifth breather chamber 44, it is possible to prevent the oil content from being blown off towards the side of the air cleaner 29 together with the gas.

Furthermore, the second breather pipe 38 which connects the fifth breather chamber 44 to the breather tank 36 is arranged not to be linear but to be curved so as to make the entire length as long as possible, thus further improving the gas-liquid separation performance.

Still furthermore, not only the second breather pipe 38 but also the other breather pipes are arranged not to be linear but to be curved so as to make the entire lengths of these pipes as long as possible, and the respective breather pipes 37, 38, and 39 are arranged at positions higher, in level, than that of the entire engine 16 including the engine intake system 26 and the engine exhaust system 27. It is therefore possible to suppress the atomized oil content mixed into the blow-by gas from flowing to the air cleaner 29. In addition, if the breather pipes are arranged along the exhaust pipes 33, water contents in the pipes would be prevented from freezing in a cold season or atmosphere.

Furthermore, the breather tank 36 is provided in parallel to the intake inlet 32 formed on the upper end of the intake duct 31 extending obliquely forward towards the upper portion of the outlet tube 30 provided above the air cleaner 29 in a plan view. Accordingly, the breather tank 36 functions as a heat shielding member to make it difficult to draw the hot air emitted from the exhaust pipe 33 from the intake port 32. As a result, it becomes possible to prevent failure at an engine starting operation and also prevent the lowering of the engine output power.

It is to be noted that the present invention is not limited to the described embodiment and many other changes and modifications may be made without departing from the scopes of the appended claims.

What is claimed is:

1. A breather device of an engine of a vehicle in which an engine, which includes a crankcase and a cylinder assembly comprising a cylinder block arranged on an upper surface of the crankcase, a cylinder head and a cylinder cover, is mounted to a vehicle body frame, an engine intake system is arranged on a rear side of the cylinder assembly, an engine exhaust system is arranged on one side of the engine, and a breather device is arranged in the vehicle body so as to release a blow-by gas in the crankcase and to separate an oil content in the blow-by gas therefrom, said breather device comprising:

a breather tank arranged independently between the engine intake system and the engine exhaust system on the rear side of the cylinder assembly and above the crankcase; and a plurality of breather pipes connecting the breather tank to the engine and the engine intake system.

2. The breather device of a vehicle engine according to claim 1, wherein said breather tank is arranged between an outlet tube of the engine intake system and an exhaust pipe of the engine exhaust system.

3. The breather device of a vehicle engine according to claim 1, wherein said breather tank has a side surface which faces the engine intake system and is curved along an outer configuration of the engine intake system.

4. The breather device of a vehicle engine according to claim 3, wherein said breather tank is provided with a plurality of breather chambers formed therein by dividing an interior thereof by means of partition walls so as to communicate with each other, and unions for connection to the breather pipes are arranged respectively to the breather chambers.

5. The breather device of a vehicle engine according to claim 4, wherein said breather tank is arranged just above the crankcase, a further breather chamber is arranged in an upper portion of the crankcase directly under the breather tank, and said further breather chamber is connected to the breather tank through the breather pipe.

6. The breather device of a vehicle engine according to claim 5, wherein said further breather chamber is communicated with one of the plural breather chambers in the breather tank through one of the plural breather pipes.

7. The breather device of a vehicle engine according to claim 1, wherein said breather pipes are arranged so as to be curved and arranged at positions higher in level than an entire structure of the engine including the engine intake system and the engine exhaust system.

8. The breather device of a vehicle engine according to claim 1, wherein said engine intake system includes air cleaner provided, at an upper portion thereof, with an intake duct extending obliquely forward towards upward, said intake duct having an intake port at an upper end of the intake duct, and said breather tank is disposed in parallel to the intake port as viewed in a plan view and arranged between the intake port and the engine exhaust system and above the engine exhaust system.

* * * * *